US011077986B2

(12) United States Patent
Fry

(10) Patent No.: US 11,077,986 B2
(45) Date of Patent: Aug. 3, 2021

(54) CORNER SUPPORT ASSEMBLY

(71) Applicant: SHOP VAC CORPORATION, Williamsport, PA (US)

(72) Inventor: Kevin D. Fry, South Williamsport, PA (US)

(73) Assignee: SHOP VAC CORPORATION, Williamsport, PA (US)

( * ) Notice: Subject to any disclaimer, the term of this patent is extended or adjusted under 35 U.S.C. 154(b) by 131 days.

(21) Appl. No.: 16/269,727

(22) Filed: Feb. 7, 2019

(65) Prior Publication Data

US 2019/0263562 A1 Aug. 29, 2019

Related U.S. Application Data

(60) Provisional application No. 62/636,743, filed on Feb. 28, 2018.

(51) Int. Cl.
*B65D 21/02* (2006.01)
*B65B 35/50* (2006.01)

(52) U.S. Cl.
CPC ..... *B65D 21/0224* (2013.01); *B65B 35/50* (2013.01)

(58) Field of Classification Search
CPC ..... B65D 5/5033; B65D 5/4283; B65D 81/053–058; B65D 71/0096; B65D 21/0224; B65B 11/004; B65B 61/20
USPC ..... 53/410; 229/199, 918; 206/453, 586; 220/646, 647, 639; 108/55.1, 57.17, 108/57.16; 52/204.58, 633
See application file for complete search history.

(56) References Cited

U.S. PATENT DOCUMENTS 825,523 A * 7/1906 Dewey ..... E04B 2/60 52/282.3
2,878,982 A * 3/1959 Gariepy ..... B65D 81/056 206/586
2,956,705 A * 10/1960 Clingman ..... A47B 47/0008 220/683
3,338,012 A * 8/1967 Kappenhagen ..... A47B 47/03 312/223.1
3,362,739 A * 1/1968 Staeger ..... E04B 1/34384 52/285.1
3,433,354 A * 3/1969 Liebel ..... B65D 85/30 206/586
D220,166 S * 3/1971 Griffith ..... D8/380
3,805,473 A 4/1974 Lidgard
3,980,221 A * 9/1976 Okada ..... B65D 5/5033 206/586
3,989,397 A * 11/1976 Baker ..... F16B 12/02 403/205
4,201,138 A * 5/1980 Cox ..... B65D 71/0096 108/55.1
4,210,274 A * 7/1980 Leonard ..... B65D 5/006 229/198.1

(Continued)

*Primary Examiner* — Dariush Seif
(74) *Attorney, Agent, or Firm* — Marshall, Gerstein & Borun LLP

(57) ABSTRACT

A corner support assembly for supporting a stack of containers includes a bar defining a corner and having a first end, a second end, an interior surface. A bracket is operatively coupled to the bar. The bracket includes a front end spaced away from the bar and a back end facing the interior surface of the bar. The bracket is disposed between the first end and the second end of the bar and oriented substantially perpendicular to the bar.

23 Claims, 7 Drawing Sheets

(56) References Cited

U.S. PATENT DOCUMENTS 4,258,519 A * 3/1981 Hugens ..... E04B 1/6112 52/282.1
4,265,184 A * 5/1981 Cox ..... B65D 71/0096 108/55.1
4,292,901 A * 10/1981 Cox ..... B65D 71/0096 108/55.1
4,496,054 A * 1/1985 Koltun ..... B65D 81/056 206/453
4,689,930 A * 9/1987 Menchetti ..... E04B 2/7409 52/275
4,712,942 A * 12/1987 Brown ..... F16B 5/00 403/174
4,731,973 A * 3/1988 Stenemann ..... A47F 3/12 52/767
4,771,893 A * 9/1988 Liebel ..... B65D 81/054 206/326
4,916,879 A * 4/1990 Boeshart ..... E04B 2/8652 249/40
5,048,689 A * 9/1991 McFarland ..... B65D 5/5033 206/453
5,181,611 A * 1/1993 Liebel ..... B65D 71/04 206/453
5,267,651 A * 12/1993 Hughes ..... B65D 5/5033 206/453
5,613,335 A * 3/1997 Rennich ..... E04F 13/06 52/254
5,658,483 A * 8/1997 Boeshart ..... E04B 2/8652 249/191
5,722,551 A * 3/1998 Cocciemiglio, Jr. .... B65D 9/24 220/4.33
5,813,537 A * 9/1998 DeReu ..... B65D 81/054 206/453
5,992,735 A 11/1999 Oosterbaan
6,012,587 A * 1/2000 McCullough ..... B65D 71/0096 206/453
6,286,683 B1 * 9/2001 Hunt ..... B65D 81/054 206/320
6,324,804 B1 * 12/2001 Hoogstraten ..... E04B 2/8652 249/191
D455,219 S * 4/2002 Ohanesian ..... D25/124
6,460,724 B1 * 10/2002 Bradford ..... B65D 5/0055 220/6
6,519,906 B2 * 2/2003 Yost ..... E04B 2/8635 249/18
6,527,119 B1 * 3/2003 Markert ..... B65D 81/054 206/453
6,564,993 B1 * 5/2003 Wassink ..... B65D 5/0055 220/642
6,915,603 B2 * 7/2005 Hunt ..... B65D 81/054 40/312
6,935,085 B2 * 8/2005 Little, Jr. ..... E04B 2/7854 52/285.1
6,971,518 B1 * 12/2005 Lowry ..... B65D 19/385 108/53.1
7,014,046 B2 * 3/2006 Niu ..... B65D 5/5033 206/320
7,066,342 B2 * 6/2006 Baechle ..... B65D 5/006 206/600
7,137,517 B2 * 11/2006 Lowry ..... B65D 5/5033 211/188
7,216,765 B2 * 5/2007 Markert ..... B65D 81/053 206/320
7,686,169 B1 * 3/2010 Harte ..... B65D 81/09 206/583
D647,212 S * 10/2011 Lavelle ..... D24/227
D654,356 S * 2/2012 Lavelle ..... D8/403
D660,454 S * 5/2012 Lavelle ..... D24/227
D704,045 S * 5/2014 Lavelle ..... D8/403
D709,360 S * 7/2014 Lavelle ..... D8/403
9,272,832 B2 * 3/2016 Grinwald ..... B65D 81/054
9,382,054 B2 * 7/2016 Grinwald ..... B65D 81/054
D770,269 S * 11/2016 Lavelle ..... D8/403
9,926,127 B2 * 3/2018 Grinwald ..... B65D 81/056
10,750,866 B2 * 8/2020 Grupenhof ..... A47F 5/116
2006/0108408 A1 * 5/2006 Lowry ..... B65D 5/321 229/199
2009/0029130 A1 * 1/2009 Stubing ..... B65D 81/053 428/213
2009/0032432 A1 * 2/2009 Kostos ..... B65D 71/0096 206/600
2010/0072096 A1 * 3/2010 Wu ..... B65D 81/053 206/453
2011/0000906 A1 * 1/2011 Wood ..... B65D 9/34 220/1.5
2012/0000815 A1 * 1/2012 Butch, Jr. ..... B65D 81/054 206/586
2014/0138271 A1 * 5/2014 Grinwald ..... B65D 81/054 206/386
2014/0238893 A1 * 8/2014 Grinwald ..... B65D 81/054 206/586
2014/0367305 A1 * 12/2014 Mizuo ..... B65D 81/053 206/585
2017/0267429 A1 * 9/2017 Grinwald ..... B65D 81/056
2018/0022525 A1 * 1/2018 D'Anglade ..... B65D 71/0096 53/410
2019/0270570 A1 * 9/2019 Jette ..... B31D 5/006

* cited by examiner

CORNER SUPPORT ASSEMBLY

FIELD OF DISCLOSURE

This disclosure relates to a support bracket for a stack of containers, and more particularly, to a corner support assembly for aligning and supporting a stack of containers.

BACKGROUND

Current methods for packaging and shipping a plurality of containers can produce significant material waste and can include many processing steps before a shipment is ready to ship. However, consumers are expecting to pay less for shipping costs, though the costs associated with shipping related to materials and labor costs generally remain unchanged. To package and ship a stack of containers, a typical process includes first stacking the containers onto a pallet, wrapping the stack with plastic sheeting (e.g., plastic stretch wrap), and inserting corner bars between the stack and the plastic sheeting before the pallet supporting the stack of containers is moved. The corner bars are used to keep the stack of containers in alignment so that the pallet may be moved without the containers moving significantly relative to each other. The corner brackets are kept against the stack of containers by the plastic sheeting, and the entire stack may be shrink wrapped before shipping. When the pallet is unloaded, the shrink wrap and plastic sheeting are often discarded and cannot be used again.

SUMMARY

In accordance with one or more exemplary aspects, a corner support assembly and/or method for stacking containers using a corner support assembly may provide a reusable and resilient apparatus for aligning stacked containers for packaging, maintaining alignment of the stacked containers during shipping, and/or protecting the containers from damage caused by clamp trucks, fork lifts, and other external forces. A corner support assembly disclosed herein includes a corner support bracket and a corner support bar. The corner support bracket is slidably coupled to the corner support bar and together form a corner support assembly that is adapted to attach to a corner of a stack of containers. One exemplary assembly may be placed at each corner of a stack of containers so that each corner of the stack is supported and aligned on the pallet during packaging and shipping.

In accordance with a first exemplary aspect, a corner support assembly for supporting a stack of containers may include a bar defining a corner and having a first end, a second end, and an interior surface. A bracket may be operatively coupled to the corner support bar. The bracket may include a front end spaced away from the bar and a back end facing the interior surface of the bar. The back end of the bracket may be disposed adjacent to the interior surface of the bar. The bracket may be disposed between the first end and the second end of the bar and may be oriented substantially perpendicular to the bar.

In accordance with a second exemplary aspect, a method of stacking containers using a corner support assembly may include placing a first container on a support surface. The first container may have a top surface, a bottom surface, and a corner. The bottom surface may be parallel to the support surface. The method may include placing a corner support assembly adjacent to the first container. The corner support assembly may include a bracket and a bar including a first end, a second end, and an interior side facing the corner of the first container. The bracket may be operatively coupled to the bar and may include a platform having a first surface and a second surface opposite the first surface. The second surface of the platform may be adjacent to the top surface of the first container.

In accordance with a third exemplary aspect, a corner support assembly for supporting a stack of containers may include a bar with a first arm, a second arm, and a corner connecting the first arm and the second arm at a right angle. The first arm, second arm, and corner may extend from a first end of the bar to a second end of the bar and may define an interior surface of the bar. A bracket may be slidably coupled to the first arm and the second arm of the bar. The bracket may include a platform having a first surface, a second surface, a back end, and a front end. The back end may be adjacent to the interior surface of the bar. The platform may be oriented substantially perpendicular relative to the bar. A first mount of the bracket may be proximally located to the front end of the platform. The first mount may be shaped to receive a portion of the first arm of the bar. A second mount may be proximally located to the front end of the platform. The second mount may be shaped to receive a portion of the second arm of the bar.

In accordance with any one or more of the foregoing first, second, or third exemplary aspects, a corner support assembly and a method of stacking containers using a corner support assembly may further include any one or more of the following preferred forms.

In a preferred form, the bar may include a first arm, a second arm, and the corner connecting the first and second arms.

In a preferred form, the bracket may be slidably coupled to the first arm and the second arm of the bar.

In a preferred form, the bracket may include a mount slidably coupled to the bar.

In a preferred form, the bracket may include a first side edge and a second side edge extending between the back end to the front end of the bracket.

In a preferred form, the first side edge may be oriented approximately 90 degrees relative to the second side edge.

In a preferred form, the mount may define a first hook disposed at the front end of the first side edge and a second hook disposed at the front end of the second side edge of the bracket.

In a preferred form, the bar may include an exterior surface opposite the interior surface.

In a preferred form, each of the first and second hooks may curve outwardly and away from the bracket and may include a portion that is disposed adjacent to the exterior surface of the bar when the bracket is operatively coupled to the bar.

In a preferred form, the mount of the bracket may define a channel disposed at the front end of the bracket.

In a preferred form, the channel may be sized to receive a portion of one of the first and second arms of the bar.

In a preferred form, the bracket may define a platform extending between the front end and the back end of the bracket and substantially perpendicular to the bar.

In a preferred form, at least one of the first and second side edges may extend perpendicularly relative to the platform to define a side wall.

In a preferred form, the front end of the bracket may have a first width and the back end of the bracket may have a second width.

In a preferred form, the first width may be greater than the second width.

In a preferred form, the back end of the bracket may be spaced away from the interior surface of the bar.

In a preferred form, the method may include placing a second container on the top surface of the first container.

In a preferred form, the second container may have a top surface, a bottom surface, and a corner.

In a preferred form, the bottom surface of the second container may be adjacent to the top surface of the first container and the corner of the second container may face the interior side of the bar.

In a preferred form, placing a corner support assembly adjacent to the first container may include inserting a front end of the bracket between the first container and the second container such that the first surface of the platform is adjacent to the bottom surface of the second container and the second surface of the platform is adjacent to the top surface of the first container.

In a preferred form, inserting the front end of the bracket between the first container and the second container may include placing the bracket on the top surface of the first container before placing the second container on the top surface of the first container.

In a preferred form, the method may include aligning the corner of the second container with the corner of the first container.

In a preferred form, the method may include adjusting a position of the bracket relative to the bar by sliding the bracket relative to the first end and the second end of the bar.

In a preferred form, the method may include placing a second corner support bracket assembly adjacent to the first container at a different corner of the first container.

In a preferred form, each of the first and second mounts may define a U-shaped channel to slidably receive a distal end of one of the first and second arms of the bar.

In a preferred form, a first side wall and a second side wall may be adjacent to the platform and may extend between the back end and the front end of the platform.

In a preferred form, the first side wall may define the first mount and the second side wall may define the second mount.

In a preferred form, the first side wall of the bracket may be parallel with the first arm of the bar. The second side wall of the bracket may be parallel with the second arm of the bar.

In a preferred form, the platform may be integrally formed with the first mount and the second mount.

In a preferred form, the back end of the platform may be spaced away from the interior surface of the bar.

In a preferred form, each mount of the first and second mounts may include a first surface and a second surface.

In a preferred form, the first surface of each of the first and second mounts may be coplanar with the first surface of the platform.

DETAILED DESCRIPTION

A corner support assembly 10 of the present disclosure is adapted to provide structural support, corner alignment, and corner protection to a stack of containers without requiring the stack of containers to be first secured by plastic sheeting. The example corner support assembly 10 may be easily coupled (e.g., attached, inserted, placed into) to a stack of containers without requiring the entire stack to be wrapped in plastic sheeting to hold the corner support assembly in place. A plurality of corner support assemblies can be used together to support a stack of containers at each corner of a four-cornered stack of containers. When supported at each corner, the stack of containers is less likely to shift out of alignment and tip over during packaging and shipping. The corner support assembly 10 facilitates the packaging and shipping process by reducing the number of steps needed to assemble, package, and ship a stack of containers. It may even be possible to avoid using any plastic wrap, since the corner support assembly 10 will tend to stay in place without wrapping for some types of stacks, though plastic wrapping provides additional stability. The wrap may be standard plastic sheeting that adheres to itself, or can be "shrink-wrap" that is later heated to give the stack additional strength and stability.

Figure 1:
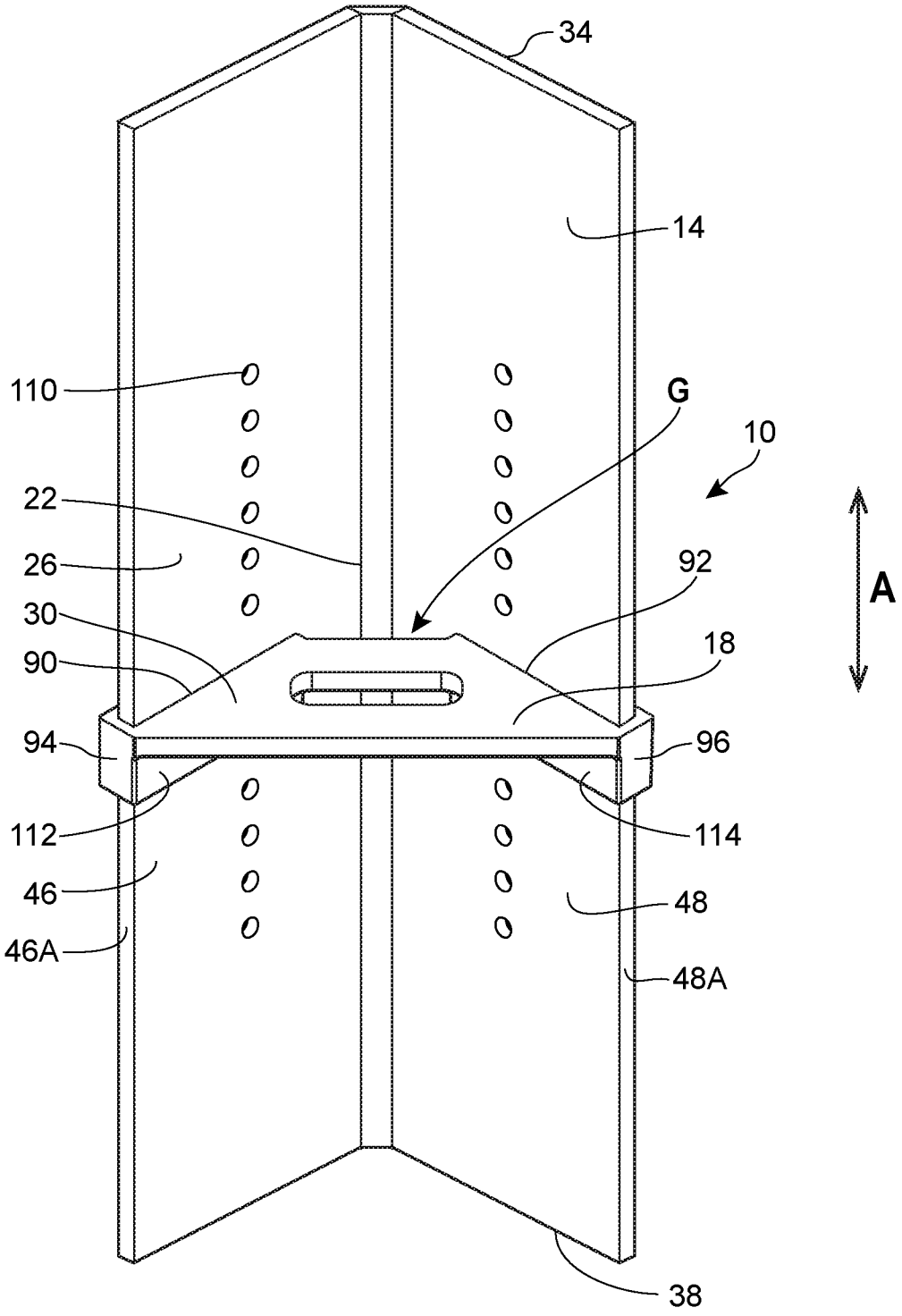
FIG. 1 is a partial perspective view of a corner support assembly including a first exemplary corner support bracket assembled in accordance with the teachings of the present disclosure.
Figure 2:
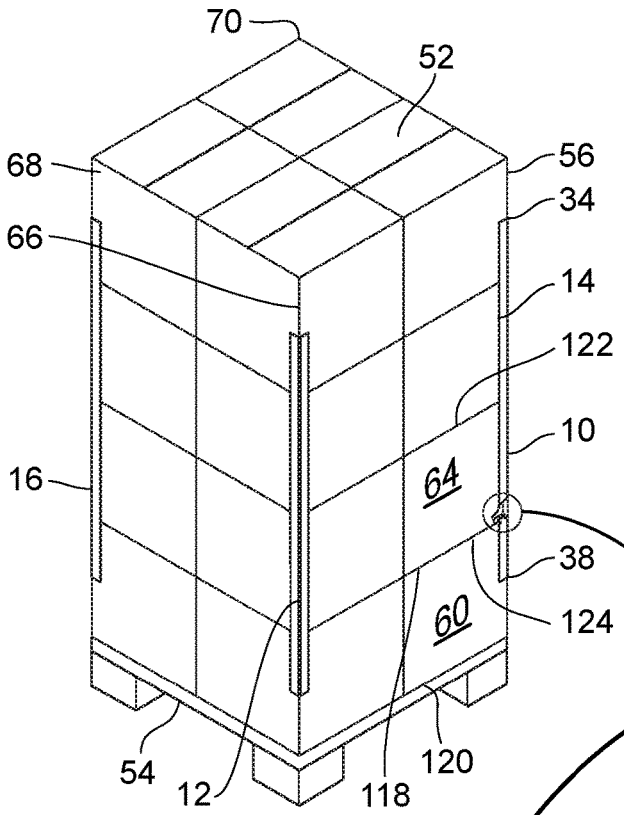
FIG. 2 is a perspective view of a plurality of corner support assemblies of FIG. 1 coupled to a stack of containers.

FIG. 1 illustrates an example corner support assembly 10 constructed in accordance with the teachings of the present disclosure. The assembly 10 includes a vertically-oriented corner support bar 14 and a bracket 18 operatively coupled and substantially perpendicular to the corner support bar 14. The bracket 18 is disposed within a corner 22 defined by the bar 14 and sits adjacent to an interior side 26 of the bar 14. The bracket 18 includes a platform 30 which is adapted to slide in between two containers of a stack of containers. The bar 14 of the assembly 10 extends between a first end 34 and a second end 38. The bar 14 includes a first arm 46, a second arm 48, and a joint or corner portion 22 connecting the first and second arms 46, 48. Each arm 46, 48 is adapted to face and/or provide a rigid support to a different side of a corner of a container. Referring to FIGS. 1 and 2, the interior side 26 of the bar 14 is configured to face a corner of a stack of containers 52, and an exterior side 28 of the bar 14 is configured to face away from the stack of containers 52.

In FIG. 2, the corner support assembly 10 is placed against a stack of containers 52, which is supported by a support surface 54, which is a shipping pallet in the illustrated example. The corner support assembly 10 is used with other similar corner support assemblies 12 and 16 to support each corner of the stack of containers 52. The corner support bar 14 of the corner support assembly 10 is vertically aligned with a corner 56 of the stack 52 and the bracket 18 is disposed between a first container 60 and a second container 64 of the stack 52. Similarly, second and third corner support assemblies 12 and 16 are attached to second and third corners 66 and 68 of the stack of containers 52. While not shown in FIG. 2, a fourth corner assembly may be attached to a fourth corner 70 of the stack 52.

Referring particularly to the first corner assembly 10, the bar 14 is suspended above the shipping pallet 54 by the corner bracket 18, which is wedged in between first and second containers 60, 64. When the corner support assembly 10 is attached to the stack of containers 52, the bar 14 supports the corner 56 of the stacked containers 52, keeping the containers 52 in alignment (e.g., stacked on top of another) and from shifting or sliding relative to one another.

Figure 3:
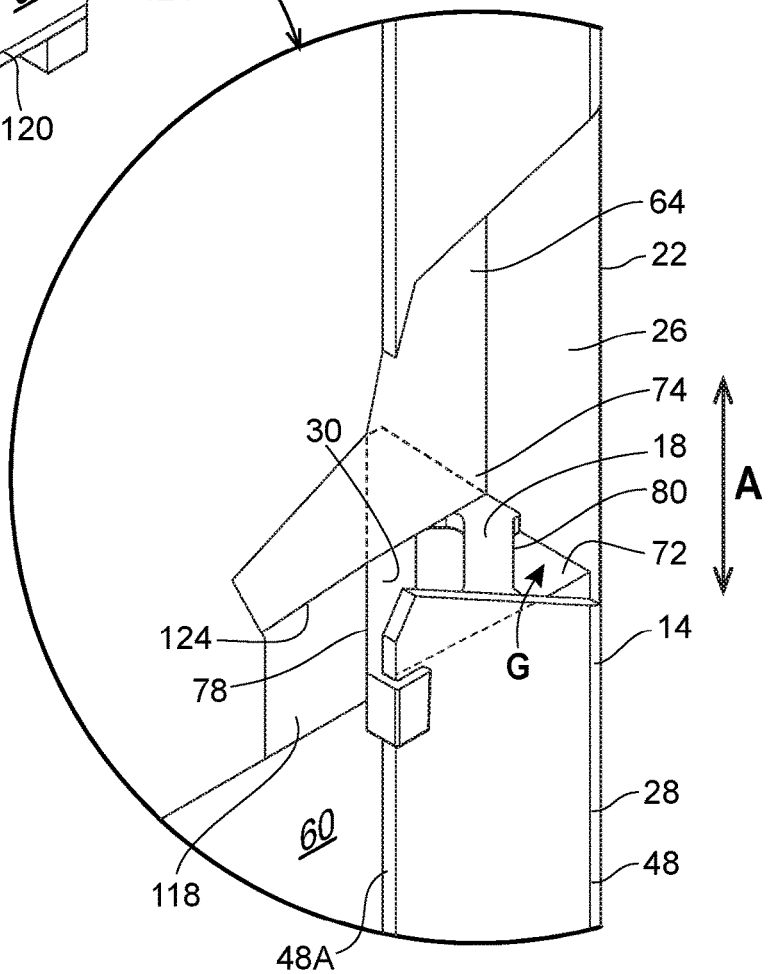
FIG. 3 is a partial, magnified view of a corner support assembly of FIG. 2.

In the magnified view of FIG. 3, the platform 30 of the bracket 18 is disposed between the first container 60 and the second container 64 such that the vertically-oriented bar 14 is positioned adjacent to corners 72, 74 of the first and second containers 60, 64, respectively. The bracket 18 includes a front end 78 placed between first and second containers 60, 64 and a back end 80 facing the corner joint 22 of the bar 14. The second container 64 is not aligned with the first container 60 in FIG. 3 to illustrate the placement of the platform 30 of the bracket 18 relative to the first container 60 and the second container 64. The first container 60 has a top surface 118 and a bottom surface 120 that are parallel to a flat receiving surface of the shipping pallet 54. The second container 64 includes a top surface 122 and a parallel bottom surface 124. As shown in FIG. 3, the bottom surface 124 of the second container 64 is adjacent to the top surface 118 of the first container 60.

The corner 72 of the first container 60 abuts against the interior side 26 of the bar 14, but is not directly contacting the corner 74 of the second container 64 stacked above the first container 60. The weight of the second container 64 imparted on to the platform 30 of the bracket 18 and/or friction between the platform 30 and the first and second containers 60, 64 tend to keep the corner support assembly 10 in place within and against the stack 52.

The bracket 18 is spaced away from the joint 22 of the bar 14 by a gap G between the joint 22 of the bar 14 and the back end 80 of the bracket 18. The gap G provides space between the two stacked containers 60 and 64 in case the corners 72, 74 of the containers 60, 64 are dented or otherwise deformed. The gap G provides room for the containers at the corners where there might be some deformation in the container structure.

Figure 4:
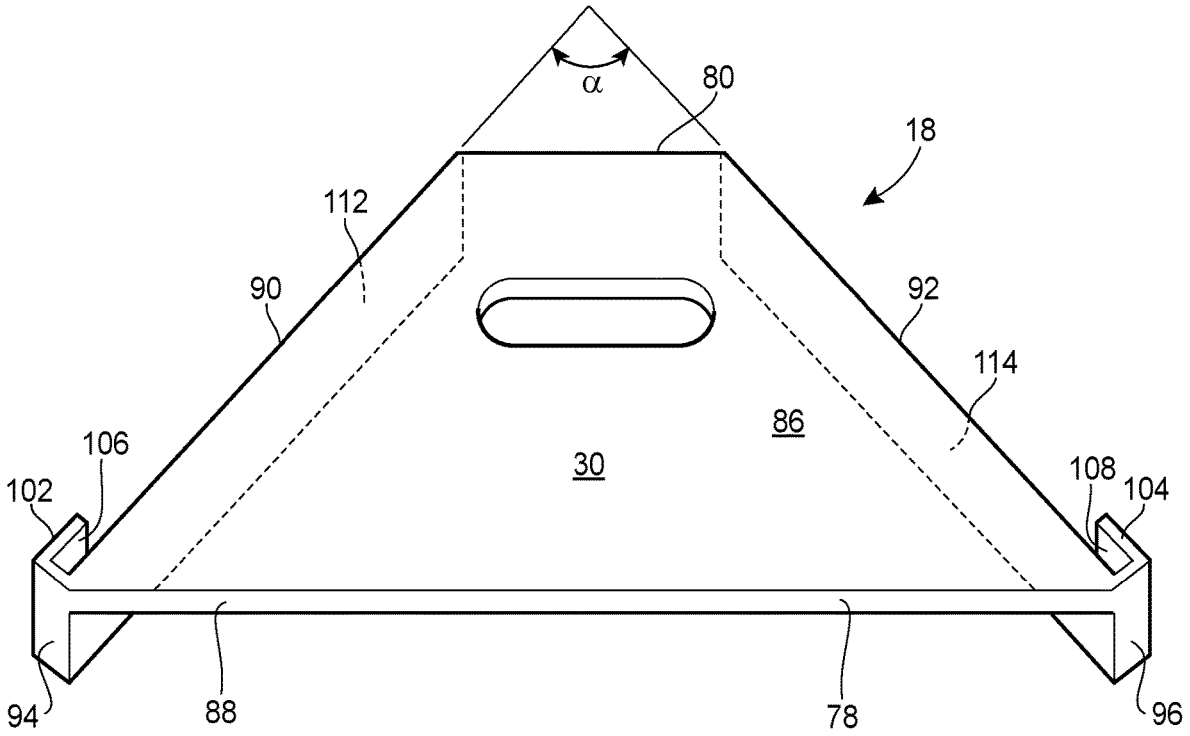
FIG. 4 is a front perspective view of the first exemplary corner support bracket of the corner support assembly of FIG. 1.
Figure 5:
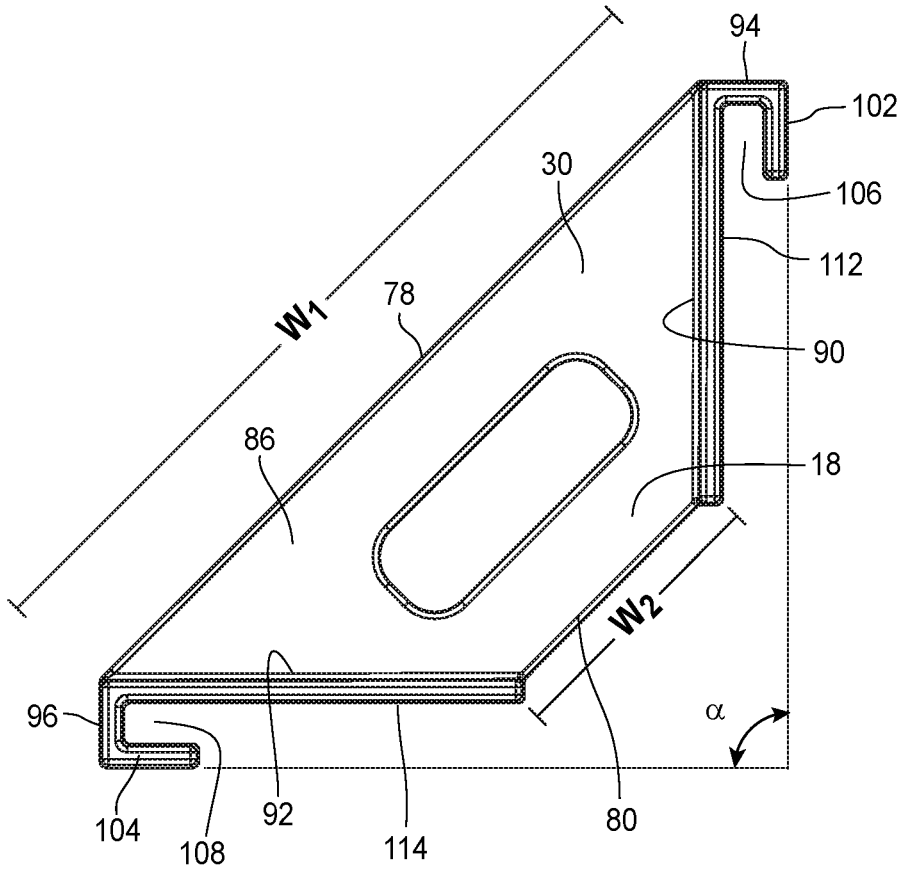
FIG. 5 is a top view of the corner support bracket of FIG. 4.
Figure 6:
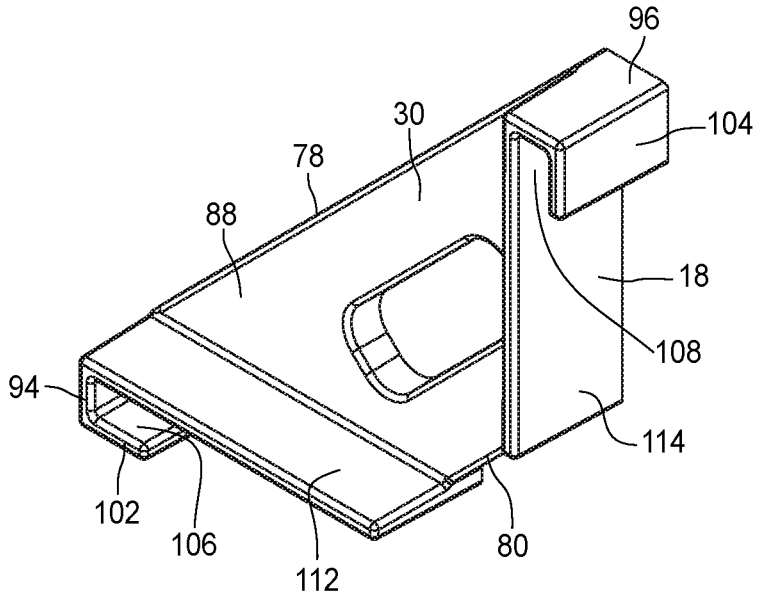
FIG. 6 is a bottom perspective view of the corner support bracket of FIG. 4.

According to the teachings of the present disclosure, the bracket 18 of the corner support assembly 10 is adapted to slidably couple to the support bar 14 while maintaining its perpendicular orientation relative to the bar 14. As shown in FIGS. 4-6, the first exemplary bracket 18 includes a front end 78, a back end 80, and the platform 30, which extends from the back end 80 to the front end 78. The back end 80 of the bracket 18 is positioned adjacent to the interior side 26 of the bar 14 and is spaced away from the bar 14 by the gap G. The bracket 18 also includes a first surface 86, a second surface 88, a first side edge 90, and a second side edge 92. Each side edge 90, 92 is adjacent to the platform 30 and each side edge 90, 92 extends between the back end 80 to the front end 78 of the bracket 18. The first side edge 90 is oriented at an angle $\alpha$ that is approximately 90 degrees, but may be less than or greater than 90 degrees. In one version, the angle $\alpha$ can be between 70 degrees and 120 degrees and may be based on the angle of the joint 22 of the bar 18.

Each side edge of the first and second side edges 90, 92 includes a mount 94, 96, which is in the form of a mounting hook disposed at the front end 78 of the bracket 18. Each mounting hook 94, 96 of the first and second side edges 90, 92 protrudes from the platform 30 such that a portion 102, 104 of each mounting hook 94, 96 wraps around the edges of each arm 46, 48 of the bar 14 so that each hook 94, 96 is partially disposed adjacent to the exterior side 28 of the corner support bar 14 when the bracket 18 is attached to the bar 14. Each mounting hook 94, 96 of the bracket 18 is slidably coupled to the first arm 46 and the second arm 48, respectively, of the corner support bar 14. A U-shaped channel 106, 108 is defined by each mounting hook 94, 96 and is sized to receive a portion of one of the first and second arms 46, 48 of the corner support bar 14. In other examples, the bracket 18 may include only one mounting hook that slidably couples the bracket 18 to the bar 14.

As shown in FIG. 5, the front end 78 of the bracket 18 has a first width W1 and the back end 80 of the bracket 18 has a second width W2 where the first width W1 is greater than the second width W2. The different widths W1, W2 of the bracket 18 define a trapezoidal shape of the platform 30. However, in other examples, the platform 30 may have a triangular or different-shaped support surface.

The mounting hooks 94, 96 may be coupled to the corner support bar 14 by a friction fit, such that the bracket 18 may slide in a vertical direction A (FIGS. 1 and 3) relative the bar 14 when a user applies a force that overcomes the force of friction between the bar 14 and the bracket 18. In other examples, the bracket 18 may include one or more protruding tabs that fit within a plurality of vertically positioned apertures 110 (FIG. 1) formed in the corner support bar 14. To move the bracket 18 relative to the bar 14, the protruding tabs are aligned with the apertures 110 of the corner support bar 14 and snap-fit into place. In yet another example, the bracket 18 may be mounted to the bar by a magnetic coupling.

In FIG. 6, first and second side walls 112, 114 extend axially away from the second surface 88 of the bracket 18 at the first and second side edges 90, 92, respectively. The first surface 86 of the platform 30 is coplanar with a top surface of the first and second side walls 112, 114 (FIG. 4). The side walls 112, 114 extend the length of each side edge 90, 92 of the bracket 18. The first and second side walls 112, 114 are arranged to face the interior side 26 of the first and second arms 46, 48 of the corner support bar 14 when the bracket 18 is coupled to the support bar 14. In this example, the first side wall 112 of the bracket 18 is parallel with the first arm 46 of the bar 14, and the second side wall 114 of the bracket 18 is parallel with the second arm 48 of the bar 14. In one example, each side wall 112, 114 is sized and shaped to engage the surface of the interior side 26 of the bar 14. The side walls 112, 114 provide additional stability to the bracket 18 so that the bracket 18 does not move or turn relative to the corner support bar 14 when the stack of containers 52 is moved. In other examples, the first and second sides edges 90, 92 may extend axially away from at least one of the first and second surfaces 86, 88 of the platform 30.

Figure 7:
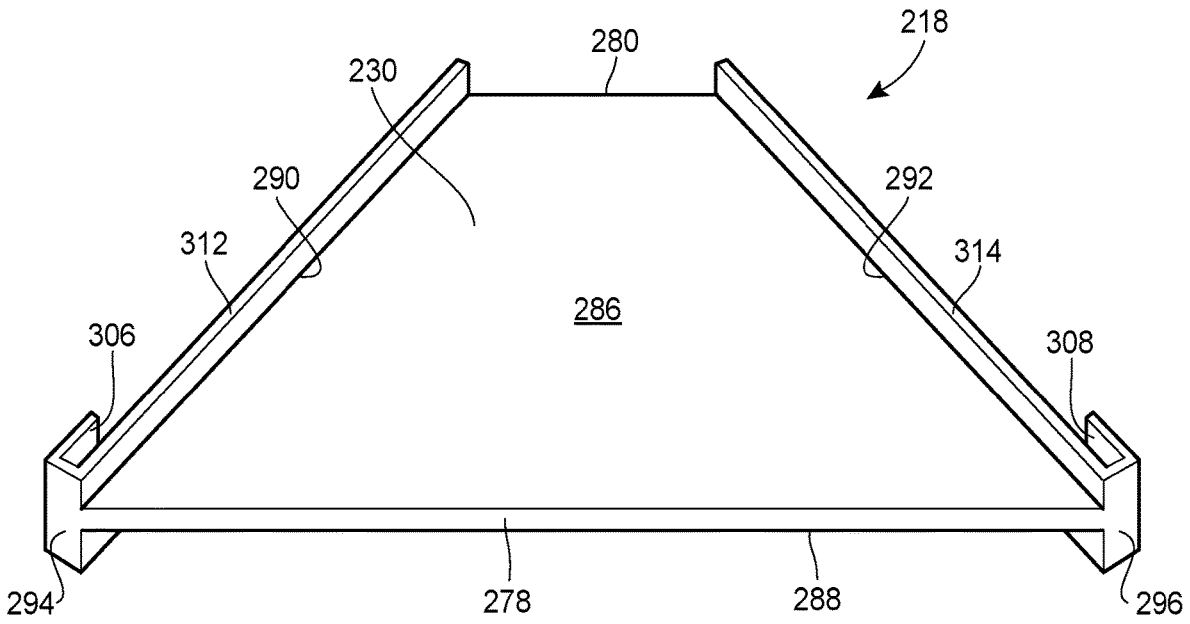
FIG. 7 is a second exemplary corner support bracket assembled in accordance with the teachings of the present disclosure.

In FIG. 7 a second exemplary bracket 218 is constructed in accordance with the teachings of the present disclosure. The second exemplary bracket 218 is similar to the first exemplary bracket 18 described above, except that the second exemplary bracket 218 includes rectangular members 312, 314 (i.e., first and second side walls) that extend from both first and second surfaces 286, 288 of a platform 230. Elements of the bracket 218 in FIG. 7 which are similar to the elements of the first exemplary bracket 18 are designated by the same reference numeral, incremented by 200.

A description of many of these elements is abbreviated or even eliminated in the interest of brevity.

The bracket 218 includes a first side edge 290 and a second side edge 292 adjacent to the platform 230, and the side edges 290, 292 extend from a back end 280 of the bracket 218 to a front end 278 of the bracket 218. First and second side walls 312, 314 extend away from a first surface 286 of the platform 230 and from a second surface 288 of the platform 230 at the side edges 290, 292. The first and second side walls 312, 314 are rectangular members and may be integrally formed with the platform 230 or may be formed separately and then attached to the platform 230 by welding or other equally suitable method. The platform 230 is perpendicularly disposed relative to each side wall 312, 314 and is centrally disposed relative to a height of the side walls 312, 314.

Figure 8:
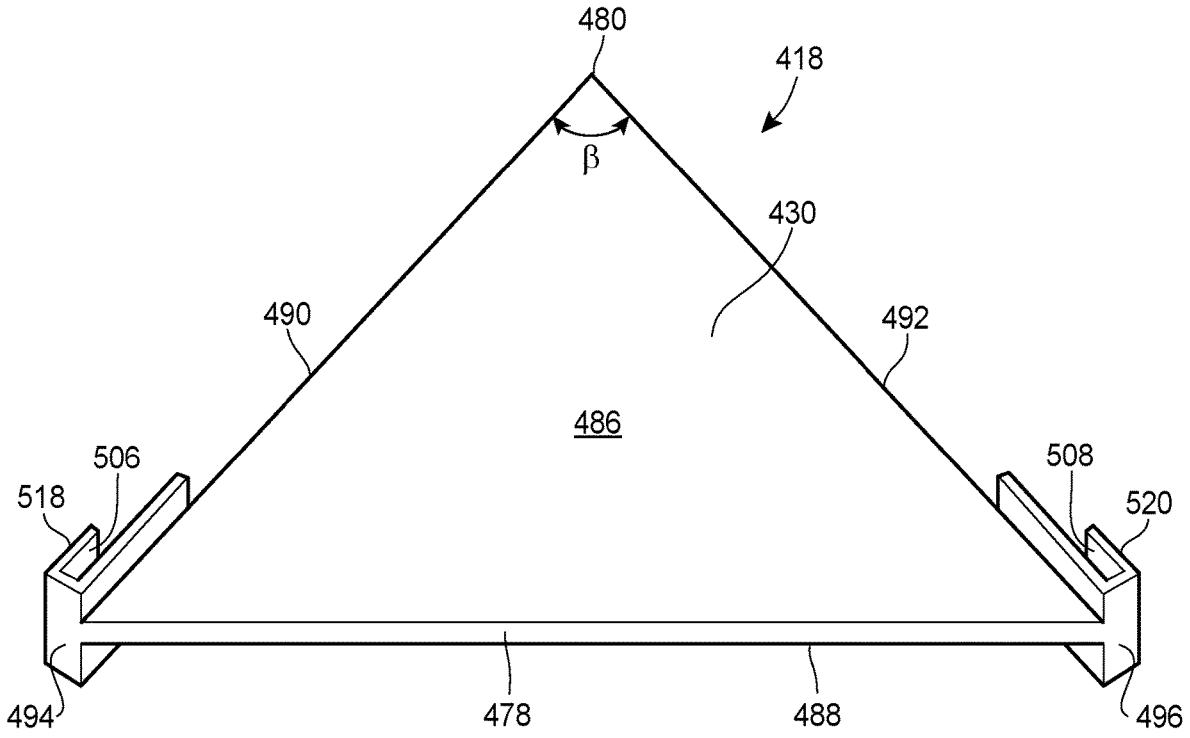
FIG. 8 is a third exemplary corner support bracket assembled in accordance with the teachings of the present disclosure.

In FIG. 8, a third exemplary bracket 418 is constructed in accordance with the teachings of the present disclosure. The third exemplary bracket 418 is similar to the second exemplary bracket 218 described above, except that a platform 430 is triangular and is configured to mount to the support bar 14 in a different manner. Elements of the third exemplary bracket 418 in FIG. 8 which are similar to the elements of the first exemplary bracket 18 are designated by the same reference numeral, incremented by 400. A description of many of these elements is abbreviated or even eliminated in the interest of brevity.

The platform 430 of the third exemplary bracket 418 includes a first surface 486 and a second surface 488, a first edge 490, and a second edge 492. Unlike the first and second exemplary brackets 18, 218 illustrated in FIGS. 1-7, the third exemplary bracket 418 defines a corner at a back end 480 of the bracket 418. The corner 480 forms an angle β, which may be 90 degrees relative to first and second edges 490, 492. In one version, the corner angle β may be between 70 degrees and 120 degrees. The corner 480 may be sized to correspond with an interior joint or corner portion 22 of the support bar 14.

The bracket 418 includes a first side flange 518 and a second side flange 520 disposed at a front end 478 of the bracket 418 to mount the bracket 418 to the support bar 14. The first side flange 518 defines a U-shaped channel 506 sized to receive a portion, and specifically a distal end 46A, of the first arm 46 of the bar 14. The second side flange 520 defines a U-shaped channel 508 sized to receive a portion, and specifically a distal end 48A of the second arm 48 of the bar 14. The first and second side flanges 518, 520 extend axially away from the first surface 486 of the platform 430 and the second surface 488 of the platform 480. Unlike the side walls 312, 314 of the second exemplary bracket 218, the flanges 518, 520 of the third exemplary bracket 418 do not extend the entire length of each side edge 490, 492 of the bracket 418. The flanges 518, 520 may be attached to the bracket 418 by welding, adhesive, or other suitable methods, or may be integrally formed with the platform 430 of the bracket 418. In some examples, an interior surface of the each flange 518, 520 may be coated with a material to help grip the arms 46, 48 of the support bar 14 when the bracket 418 is coupled to the bar 14. In other examples, the flanges 518, 520 may be a flexible or deformable material and are configured to slightly change shape to grip a variety of shapes and sizes of the support bar 14.

Figure 9:
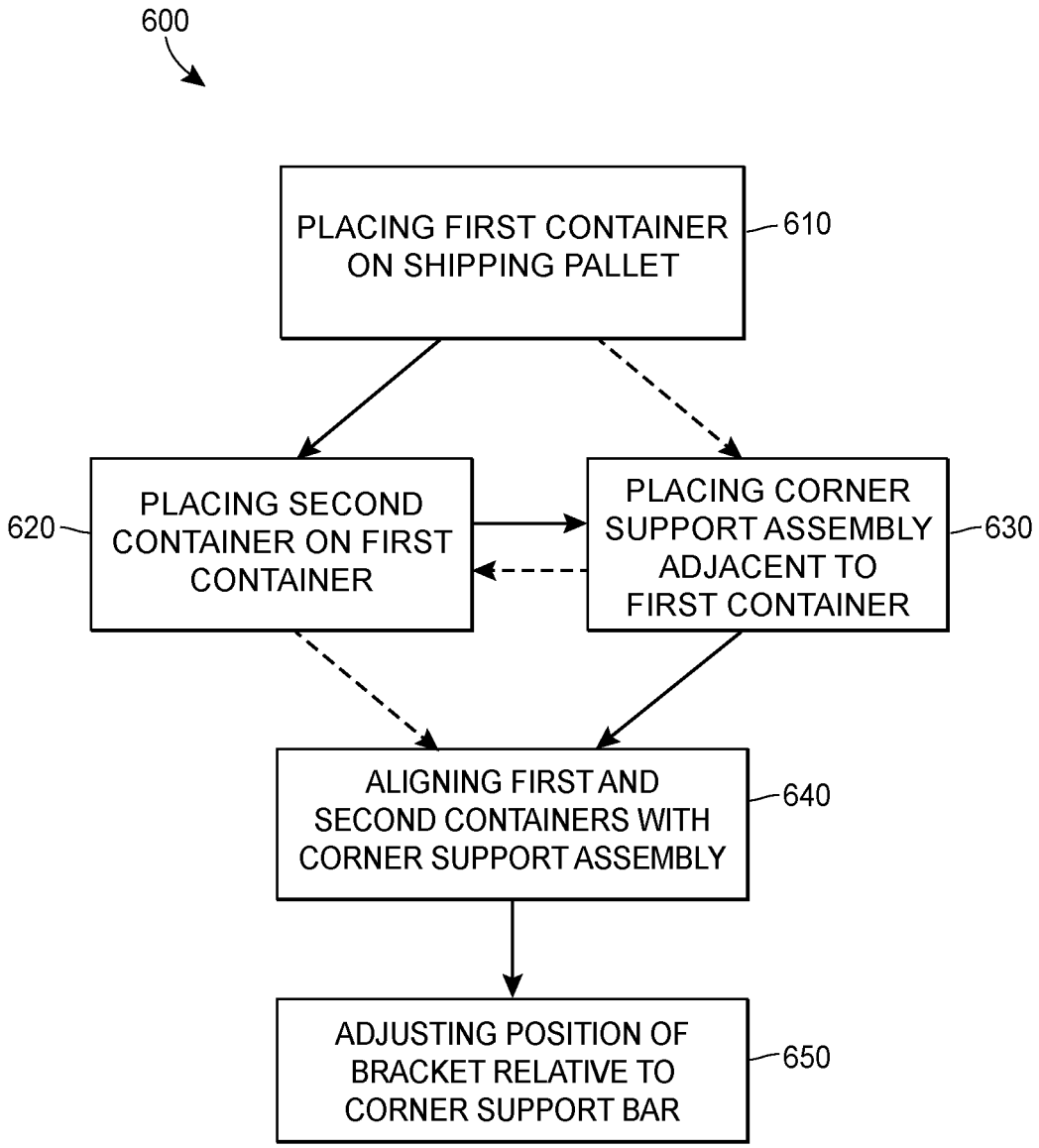
FIG. 9 is a schematic diagram of one example of a process or method for stacking containers using a corner support bracket assembly according to the teachings of the present disclosure.

FIG. 9 is a diagram of an example method or process 600 according to the teachings of the present disclosure. The method or process 600 schematically depicted in FIG. 9 is a method or process of stacking containers using a corner support assembly, such as the corner support assembly 10 illustrated in FIGS. 1-3. The method 600 includes a step 610 of placing a first container 60 on a support surface (e.g., a shipping pallet 54), the first container 60 has a top surface 118, a bottom surface 120, and a corner 72, where the bottom surface 120 is parallel to a flat receiving surface of the shipping pallet 54. The first container 60 is placed directly on the shipping pallet 54 in FIG. 2, but in another example, the first container 60 may be placed on a different container on the shipping pallet 54. The method 600 may further include a step 620 of placing a second container 64 on the top surface 118 of the first container 60. The second container 64 includes a top surface 122, a bottom surface 124, and at least one corner 74. The bottom surface 124 of the second container 64 is adjacent to the top surface 118 of the first container 60. The method or process 600 also includes a step 630 of placing a corner support assembly 10 adjacent to the first container 60. The corner support assembly 10 includes one of the first, second, or third exemplary brackets 18, 218, 418 and a corner support bar 14, where the corner support bar 14 includes a first end 34, a second end 38, an interior side 26, and an exterior side 28. In this exemplary method 600, the first exemplary bracket 18 will be used to describe the various method steps, however, any of the exemplary brackets 18, 218, 418 may be used. The bracket 18 is operatively coupled to the corner support bar 14 and includes the platform 30 having the first surface 86 and the second surface 88. The second surface 88 of the platform 30, is adjacent to the top surface 118 of the first container 60 and the interior side 26 of the corner support bar 14 is adjacent to the corner 72 of the first container 60.

The step 630 of placing the corner support assembly 10 adjacent to the first container 60 may include inserting the platform 30 of the bracket 18 after the second container 64 is placed on top of the first container 60 of the stack of containers 52. The platform 30 of the bracket 18 is placed in between the first container 60 and the second container 64 so that the first surface 86 of the platform 30 is adjacent to the bottom surface 124 of the second container 64 and the second surface 88 of the platform 30 is adjacent to the top surface 118 of the first container 60. More particularly, the platform 30 may be inserted between the corner 72 of the first container 60 and the corner 74 of the second container 64. Alternatively, the method of 600 may include placing the bracket 18 in between the first container 60 and the second container 64 by placing the bracket 18 on the top surface 118 of the first container 60 before placing the second container 64 on the top surface 118 of the first container 60.

A step 640 of the method 600 may include aligning the first and second containers 60, 64 with the assembly 10. This step 640 may include aligning the corner 72 of the first container 60 and the corner 74 of the second container 64 and then placing the interior side 26 of the support bar 14 adjacent to the corner 72 of the first container 60 and the corner 74 of the second container 64. Further, a step 650 of the method 600 may include adjusting a position of the bracket 18 relative to the corner support bar 14 by sliding the bracket 18 relative to the first end 34 and the second end 38 of the corner support bar 14. This step 650 may occur before inserting the bracket 18 between the first and second containers 60, 64. Moreover, the method 600 may include attaching a second corner support bracket assembly 12 to the stack of containers 52. The second corner support bracket assembly 12 may be attached to a different corner 66 of the stack of containers 52. However, in another example, a corner support bracket assembly 12 may be placed vertically above the first corner support bracket assembly 10 at the same corner 56 of the stack 52. As shown in FIG. 2, the second corner 66 may be defined by two different containers. However, in another example, the second corner 66 may be defined by the same first and second containers 60, 64.

Using the corner support assembly 10 of the present disclosure in the packaging and shipping process may help reduce waste associated with packaging and shipping. To ensure the stack can be moved and transported without the individual containers shifting relative to one another, the corner support assembly 10 should be placed between containers to maintain the alignment of the stack 52 during each step of packaging and shipping process. The corner support assembly 10 is also reusable and may be adjusted according to different size stacks. The exemplary brackets 18, 218, 418, as described earlier, are slidable coupled relative to the corner support bar 14. Each of the exemplary brackets 18, 218, 418 may be inserted first between two containers 60, 64 of the stack 52 and the support bar 14 may be subsequently adjusted by sliding the support bar 14 in the vertical direction relative to the bracket 18. Alternatively, a user may attach multiple brackets to a single support bar 14 prior to attaching the assembly 10 to the stack of containers 52 for additional support. The position of the bracket 18, 218, 418 relative to the support bar 14 may be adjusted to account for changes in the stack 52, e.g., containers are removed or added to the stack 52. The corner support bar 14 is shaped to form an extruded right-angle bar. In the present example, the corner support bar 14 forms a right-angle to abut against a stack of rectangular containers 52. However, the support bar 14 may be shaped to abut against an irregular shaped stack, for example, a plurality of containers stacked in a triangular column. In this example, the corner support bar 14 may be shaped to provide an angle to fit a triangular corner. In yet another example, the interior surface 26 of the support bar 14 may have a radius of curvature to abut against a stacked, rounded column of containers.

The figures and description provided herein depict and describe preferred embodiments of a corner support bracket assembly for purposes of illustration only. One skilled in the art will readily recognize from the foregoing discussion that alternative embodiments of the components illustrated herein may be employed without departing from the principles described herein. Thus, upon reading this disclosure, those of skill in the art will appreciate still additional alternative structural and functional designs of a corner support bracket. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the methods and components disclosed herein without departing from the spirit and scope defined in the appended claims.

What is claimed:

1. A corner support assembly for supporting a stack of containers, the assembly comprising:

a bar defining a corner and having a first end, a second end, and an interior surface; and a bracket operatively coupled to the bar, the bracket including a front end spaced away from the bar and a back end facing the interior surface of the bar;

wherein the bracket is disposed between the first end and the second end of the bar and oriented substantially perpendicular to the bar;

wherein the back end of the bracket is spaced from the corner of the bar.

2. The assembly of claim 1, wherein the bar includes a first arm, a second arm, and the corner connecting the first and second arms, wherein the bracket is slidably coupled to the first arm and the second arm of the bar.

3. The assembly of claim 1, wherein the bracket includes a mount slidably coupled to the bar.

4. The assembly of claim 3, wherein the bracket further includes a first side edge and a second side edge, the first and second side edges extending between the back end and the front end of the bracket, the first side edge oriented approximately 90 degrees relative to the second side edge.

5. The assembly of claim 4, wherein the mount defines a first hook disposed at the front end of the first side edge and a second hook disposed at the front end of the second side edge of the bracket.

6. The assembly of claim 5, wherein the bar includes an exterior surface opposite the interior surface, and wherein each of the first and second hooks curves outwardly and away from the bracket and includes a portion that is disposed adjacent to the exterior surface of the bar when the bracket is operatively coupled to the bar.

7. The assembly of claim 4, wherein the bracket defines a platform extending between the front end and the back end of the bracket and oriented substantially perpendicular to the bar.

8. The assembly of claim 7, wherein at least one of the first and second side edges extends perpendicularly relative to the platform to define a side wall.

9. The assembly of claim 3, wherein the mount of the bracket defines a channel disposed at the front end of the bracket, the channel sized to receive a portion of one of the first and second arms of the bar.

10. The assembly of claim 3, wherein the mount is spaced from the corner of the bar.

11. The assembly of claim 1, wherein the front end of the bracket has a first width and the back end of the bracket has a second width, the first width being greater than the second width.

12. A method of stacking containers using a corner support assembly, the method comprising:

placing a first container on a support surface, the first container having a top surface, a bottom surface, and a corner, the bottom surface parallel to the support surface; and placing a corner support assembly adjacent to the first container, the corner support assembly including a bracket and a bar, the bar including a first end, a second end, and an interior side defining a joint facing the corner of the first container, the bracket operatively coupled to the bar and including a platform having a first surface, a second surface opposite the first surface, a front end, and a back end opposite the front end, the back end spaced from the joint of the bar and the second surface of the platform adjacent to the top surface of the first container.

13. The method of claim 12, further comprising placing a second container on the top surface of the first container, the second container having a top surface, a bottom surface, and a corner, the bottom surface of the second container adjacent to the top surface of the first container and the corner of the second container facing the interior side of the bar.

14. The method of claim 13, wherein placing a corner support assembly adjacent to the first container includes inserting a front end of the bracket between the first container and the second container such that the first surface of the platform is adjacent to the bottom surface of the second container and the second surface of the platform is adjacent to the top surface of the first container.

15. The method of claim 14, wherein inserting the front end of the bracket between the first container and the second container includes placing the bracket on the top surface of the first container before placing the second container on the top surface of the first container.

16. The method of claim 12, further comprising adjusting a position of the bracket relative to the bar by sliding the bracket relative to the first end and the second end of the bar.

17. The method of claim 12, further comprising placing a second corner support bracket assembly adjacent to the first container at a different corner of the first container.

18. A corner support assembly for supporting a stack of containers, the assembly comprising:

a bar including a first arm, a second arm, and a joint connecting the first arm and the second arm at a right angle, wherein the first arm, second arm, and joint extend from a first end of the bar to a second end of the bar and define an interior surface of the bar; and a bracket slidably coupled to the first arm and the second arm of the bar, the bracket comprising:

a platform having a first surface, a second surface, a back end, and a front end, wherein the back end is adjacent to the interior surface of the bar and spaced from the joint, the platform oriented substantially perpendicular relative to the bar;

a first mount proximally located to the front end of the platform, the first mount shaped to receive a portion of the first arm of the bar; and a second mount proximally located to the front end of the platform, the second mount shaped to receive a portion of the second arm of the bar.

19. The corner support assembly of claim 18, wherein each of the first and second mounts defines a U-shaped channel to slidably receive a distal end of one of the first and second arms of the bar.

20. The corner support assembly of claim 18, further including a first side wall and a second side wall adjacent to the platform and extending between the back end and the front end of the platform, the first side wall defining the first mount and the second side wall defining the second mount.

21. The corner support assembly of claim 20, wherein the first side wall of the bracket is parallel with the first arm of the bar, and the second side wall of the bracket is parallel with the second arm of the bar.

22. The corner support assembly of claim 18, wherein the platform is integrally formed with the first mount and the second mount.

23. The corner support assembly of claim 18, wherein the first and second mounts are spaced from the joint of the bar.

* * * * *